United States Patent [19]

Fenton

[11] Patent Number: 4,513,475

[45] Date of Patent: Apr. 30, 1985

[54] HINGES AND HINGED ARTICLES

[75] Inventor: Geoffrey J. Fenton, Sandfly, Australia

[73] Assignee: Magnetic Engineering Pty. Ltd., Australia

[21] Appl. No.: 485,067

[22] Filed: Apr. 14, 1983

[30] Foreign Application Priority Data

Apr. 14, 1982 [AU] Australia ..... PF3583

[51] Int. Cl.[3] ..... E05D 3/10

[52] U.S. Cl. ..... 16/360; 16/367

[58] Field of Search ..... 16/367, 366, 368, 369, 16/370, 371, 355, 356, 357, 224, 360, 361

[56] References Cited

U.S. PATENT DOCUMENTS

| | | | |
|---|---|---|---|
| 2,085,616 | 6/1937 | Voge | 16/367 |
| 2,178,908 | 11/1939 | Harrington | 16/367 |
| 2,225,178 | 12/1940 | Nicholson | 16/367 |
| 2,754,537 | 7/1956 | Rose | 16/367 |
| 3,594,853 | 7/1971 | Slattery | 16/367 X |

*Primary Examiner*—James M. Meister
*Assistant Examiner*—John L. Knoble
*Attorney, Agent, or Firm*—Andrus, Sceales, Starke & Sawall

[57] ABSTRACT

A hinged article comprising a first body, a second body, a hinge interconnecting the first and second bodies and defining a hinge line and wherein the hinge includes a hinge comprising a first member mounted to the first body and arranged to pivot about a first pivot axis; a projection of which first pivot axis is inclined to the hinge line; and a coupling articulating the first member to the second body.

17 Claims, 34 Drawing Figures

Figures 1, 2, 3:
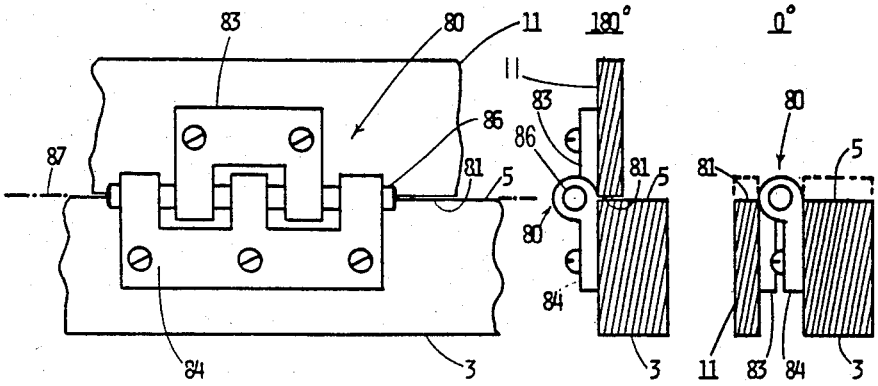

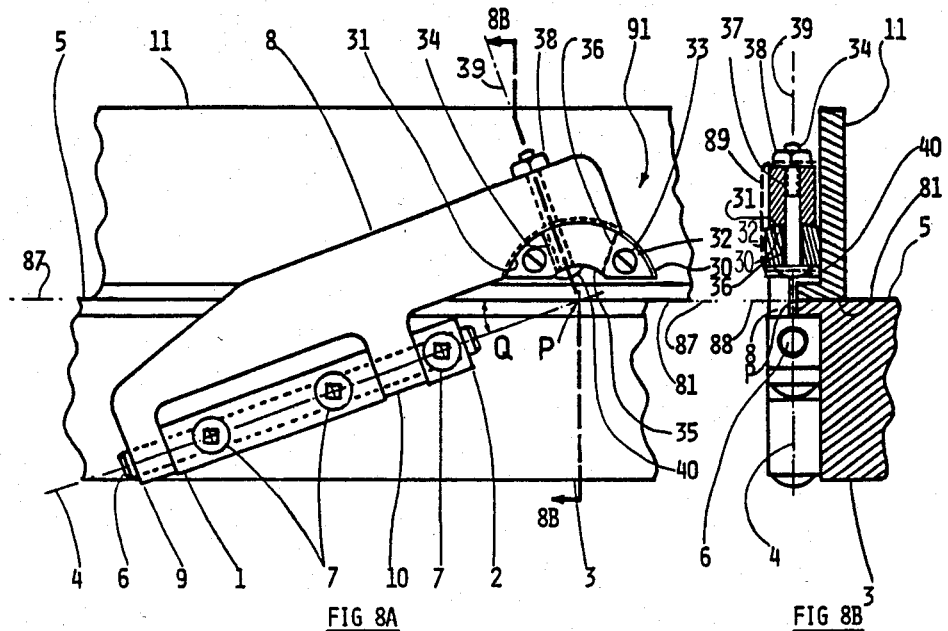
FIG 8A
FIG 8B
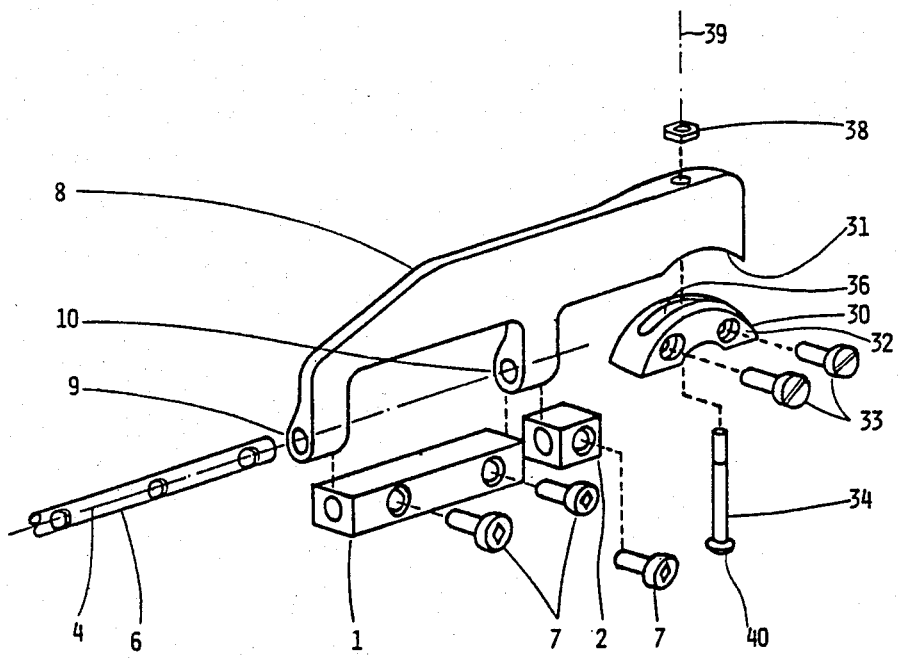
FIG 7

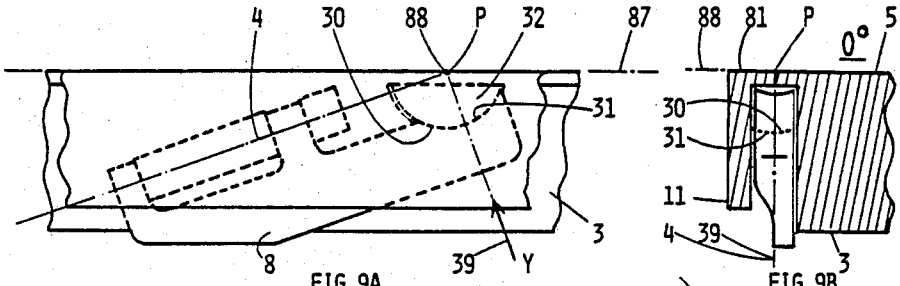
FIG 9A
FIG 9B
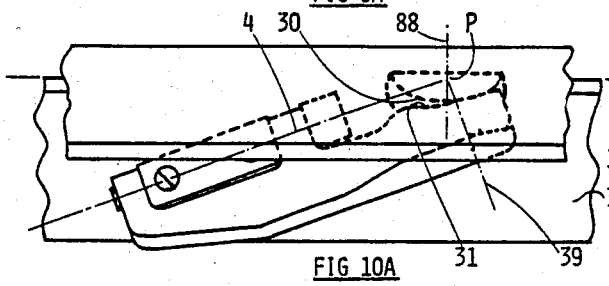
FIG 10A
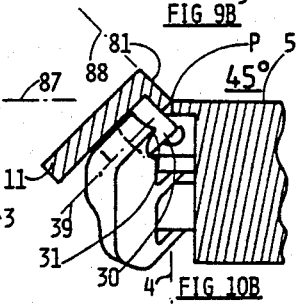
FIG 10B
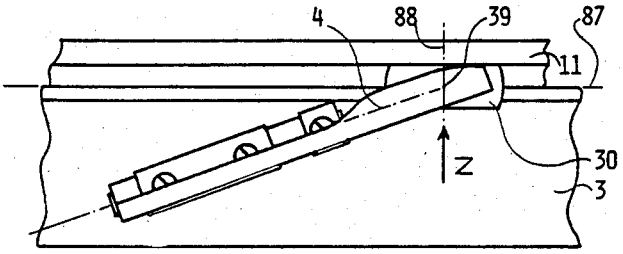
FIG 11A
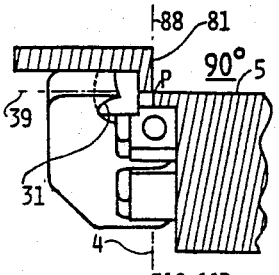
FIG 11B
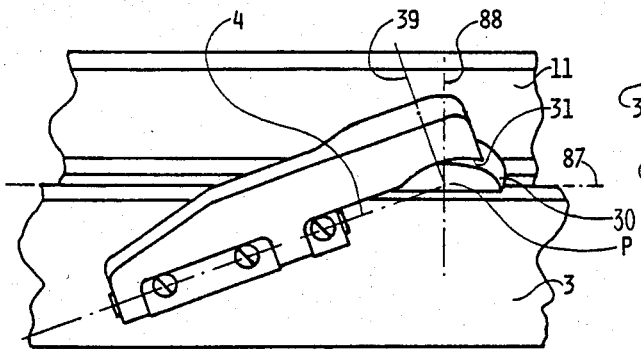
FIG 12A
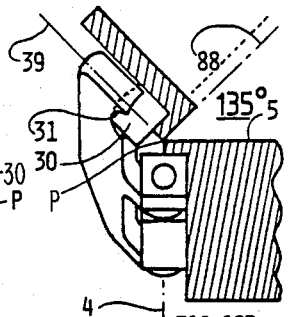
FIG 12B

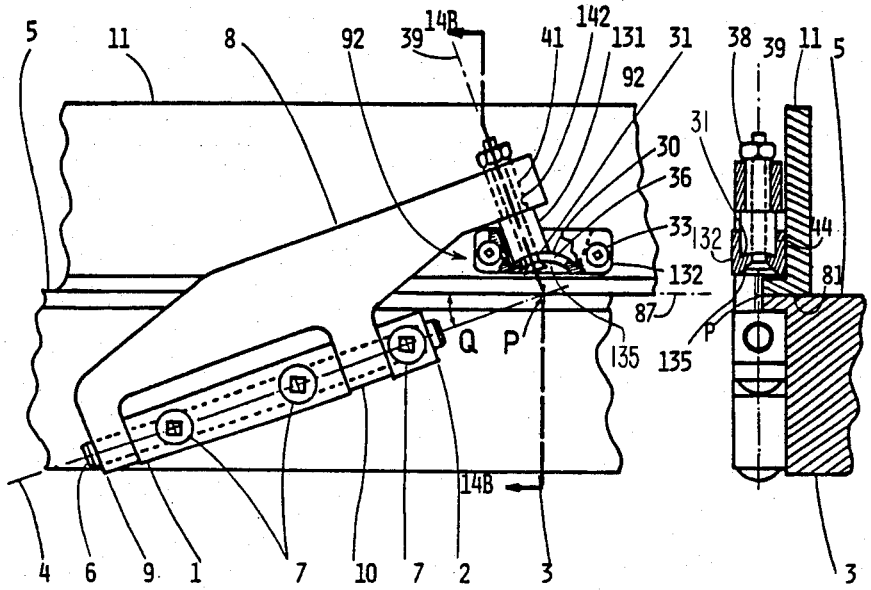
FIG 14A
FIG 14B
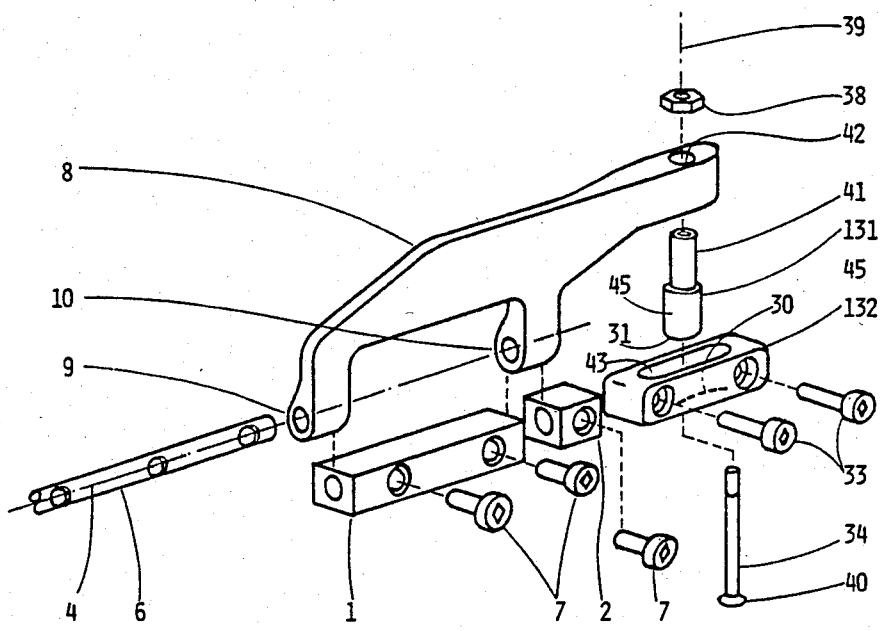
FIG 13

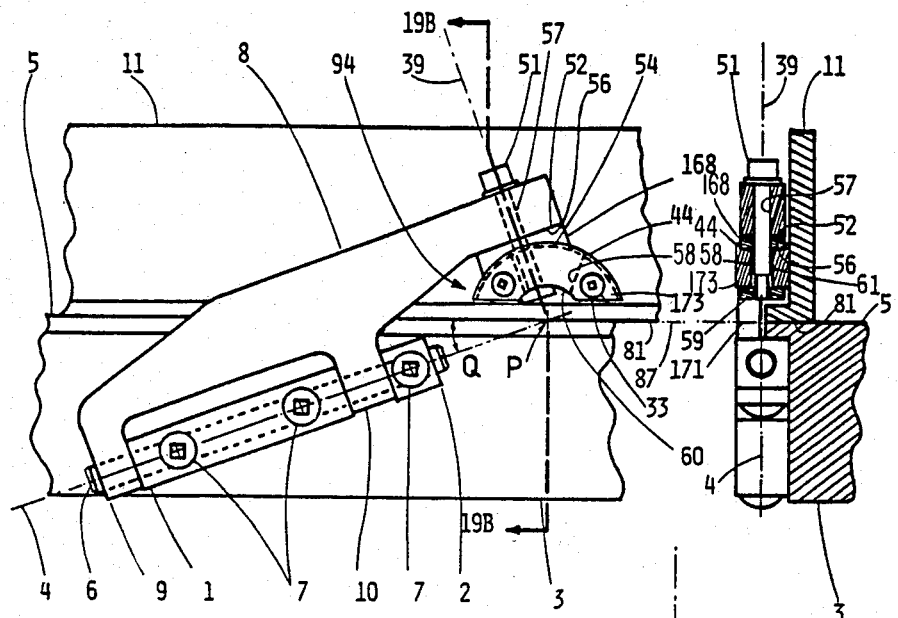
FIG 19A
FIG 19B
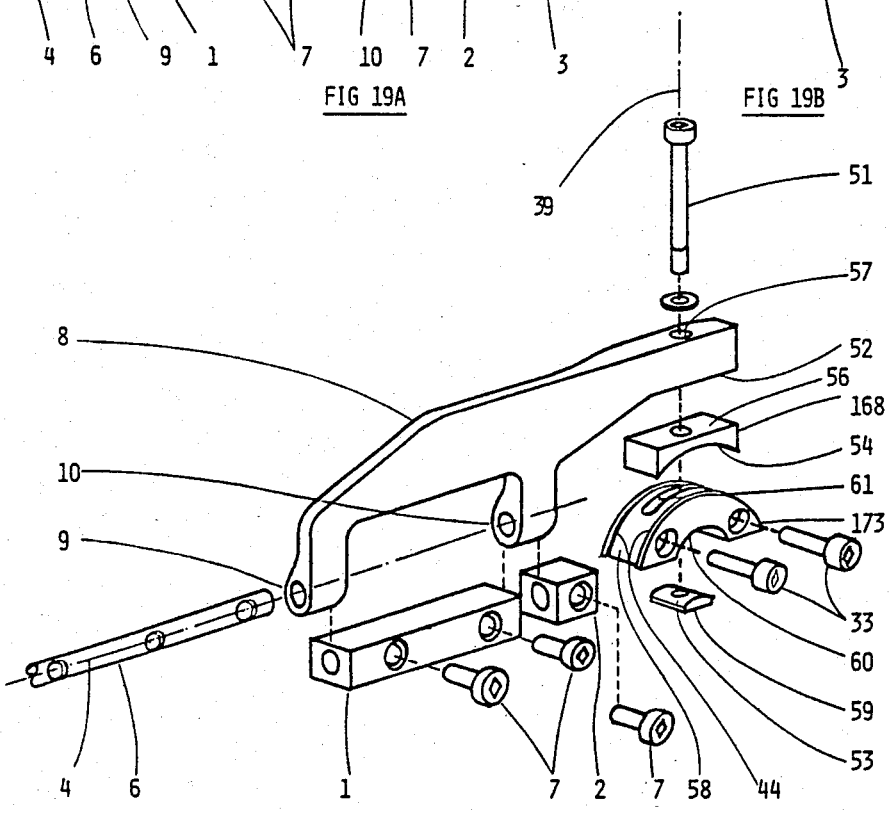
FIG 18

HINGES AND HINGED ARTICLES

This invention relates to hinges and hinged articles.

In a particular aspect this invention relates to a bending machine having a hinge in accordance with this invention.

Reference is made to Australian Pat. No. 506,793. The whole of the subject matter of the specification thereof is to be considered to be imported hereinto.

The hinges shown in Australian Patent Specification No. 506,793 have not proved to be satisfactory in practice.

Accordingly, it is one object of this invention to provide a hinge which will be useful in making bending machines of the type shown in Australian Patent Specification No. 506,793.

However, the hinges provided by the present invention have broader application such as to other bending machines and also for doors and cupboards among other things.

The present invention provides a hinged article comprising a first body, a second body, and hinge means interconnecting the first and second bodies and defining a hinge line and wherein the hinge means includes a hinge comprising a first member mounted to the first body and arranged to pivot about a first pivot axis; a projection of which first pivot axis is inclined to said hinge line; and coupling means articulating the first member to the second body.

The present invention also provides a hinged article comprising a first body, a second body, and hinge means interconnecting the first and second bodies and defining a hinge line and wherein the hinge means includes a hinge comprising a first member mounted to the first body and arranged to pivot about a first pivot axis; a projection of which first pivot axis is inclined to said line; and a coupling interconnecting the first member and the second body and at least in part constraining the bodies to hinge at least substantially about said line and compensating for the inclination of said first pivot axis.

The present invention also provides a hinged article comprising a first body, a second body, hinge means interconnecting the first and second bodies and constraining said bodies to hinge about a hinge line and wherein the hinge means includes a hinge comprising a first member pivotally mounted to the first body about a first pivot axis; a projection of which first pivot axis intersects said hinge line at an angle and at a point; and a coupling articulating the first member to the second body and permitting two degrees of freedom of relative rotation about said point.

The present invention also provides a hinged article comprising a first body, a second body, hinge means interconnecting the first and second bodies; and wherein the hinge means includes a hinge which comprises a first member pivotally mounted to the first body to pivot about a first pivot axis, and a coupling attached to the first member and to the second body and defining a second pivot axis about which the first member can pivot; and constructed and arranged such that projections of said first pivot axis and said second pivot axis of said hinge intersect at a point, about said point said second pivot axis of said hinge is able to pivot, whereby a hinge line about which said bodies can hinge is defined which extends through said point and wherein a projection of said first pivot axis of said hinge intersects said hinge line at an angle.

The present invention also provides a hinge comprising means defining a first pivot axis, first mounting means for mounting said first pivot axis to a first body with said first pivot axis inclined to a hinge line, a first member adapted to pivot about said first pivot axis, and a coupling means for articulating the first member to a second body hingeable about said hinge line.

The present invention also provides a hinge comprising means defining a first pivot axis, first mounting means for mounting said first pivot axis to a first body with said first pivot axis inclined to a hinge line, a first member adapted to pivot about said first pivot axis, and a coupling for interconnecting the first member to a second body, at least in part constraining the bodies to hinge at least substantially about said line and for compensating for the inclination of said first pivot axis.

The present invention also provides a hinge comprising means defining a first pivot axis, first mounting means for mounting said first pivot axis to a first body with said first pivot axis inclined to a hinge line, a first member adapted to pivot about said first pivot axis, and a coupling for articulating the first member to a second body and permitting two degrees of freedom of relative rotation about the point at which said first pivot axis intersects said hinge line.

The present invention also provides a hinge comprising means defining a first pivot axis, first mounting means for mounting said first pivot axis to a first body with said first pivot axis inclined to a hinge line, a first member adapted to pivot about said first axis, and a coupling for articulating the first member to a second body and defining a second pivot axis about which the first member can pivot; and constructed and arranged such that a projection of said first pivot axis and said second pivot axis intersect at a point and, in use, at said hinge line, and about which point said second pivot axis is able to pivot.

Preferably, said second pivot axis is able to rotate about a third pivot axis fixed relative to said second body and which intersects said point.

In one instance the first member is mounted for reciprocating sliding movement along said first pivot axis. In this instance it is preferred that said coupling comprises a second member pivotally attached to said first member to pivot about a second pivot axis, and pivotally attached to said second body to pivot about a third pivot axis. Preferably, projections of said third pivot axis do not intersect said hinge line. Preferably, projections of said second pivot axis do not intersect with projections of said third pivot axis.

In another instance, said coupling comprises a concave partial spherical surface carried by said first member and a mating convex partial spherical surface carried by said second body and wherein the centres about which the partial spherical surfaces are formed are coincident at said point. In this instance it is preferred that parallel spaced apart guide means is positioned on opposite sides of the convex partial spherical surface to guide the motion of said first member.

In another instance, said coupling comprises a second member mounted to said first member to rotate about said second axis and to said second body to rotate about said third axis. In this instance it is possible that said coupling comprises a concave partial cylindrical surface carried by said second member and a mating convex partial cylindrical surface carried by said second body and wherein the axes about which the partial cylindrical surfaces are formed intersect said point and it is preferred that parallel spaced apart guide means is positioned on opposite sides of the convex partial cylindrical surface to guide the motion of said second member. In an alternative, said third pivot axis is inclined at an acute angle to said second pivot axis.

The present invention has particular but not exclusive application to bending machines.

Accordingly, the present invention also provides a hinged article in accordance with this invention which is a bending machine.

It is to be noted that hinges in accordance with this invention may, of themselves alone, define only a point of pivoting rather than a line and may need to be associated with one or more other hinges to define a line. Those one or more other hinges may be hinges in accordance with this invention and may in certain circumstances be conventional hinges.

When applied to bending machines, it will be most usual for the first and second bodies to have planar work faces which in one position of the machine will lie in a plane and the hinge line will also lie in that plane. However, some bending machines may have the work faces lying in parallel planes and in other machines the hinge line may lie above the first mentioned plane and/or may be relatively more adjacent one of the work surfaces than the other of the work surfaces. Further, by selecting hinges in accordance with this invention which have axes located in particular dispositions perturbations of the rotation of one of the work surfaces can be obtained which will be beneficial in certain bending machines.

Figures 4, 5, 6:
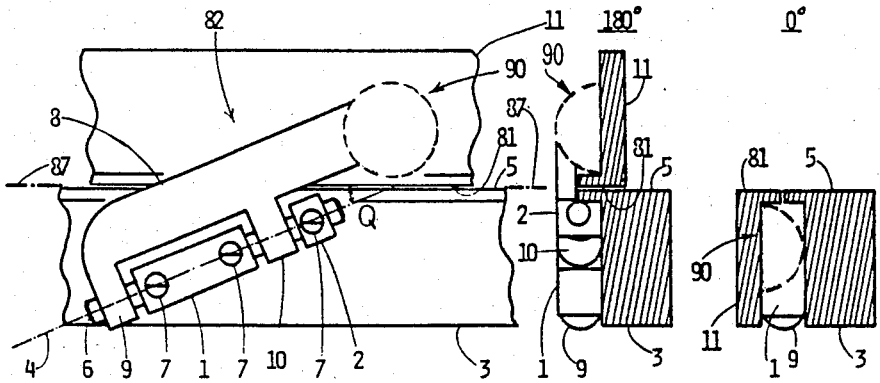
Figure 16A:
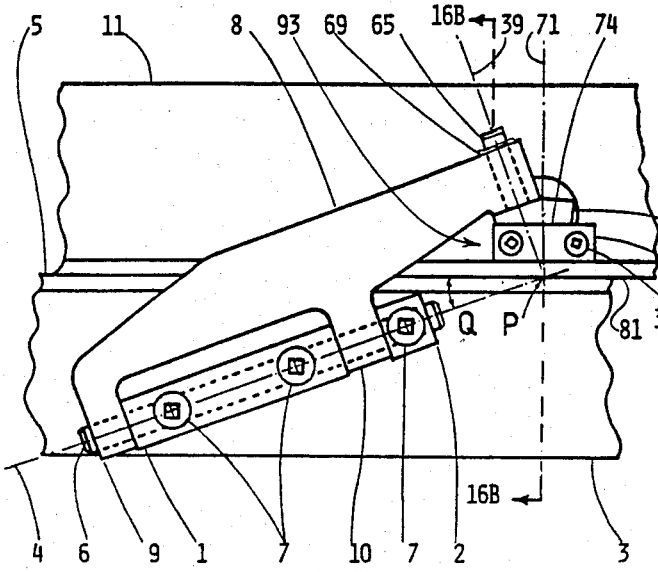
Figure 16B:
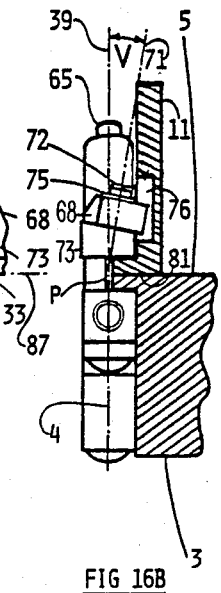
Figure 17:
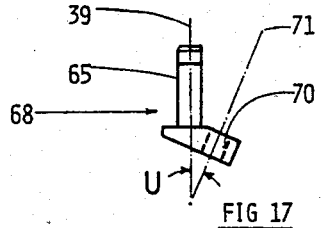
Figure 15:
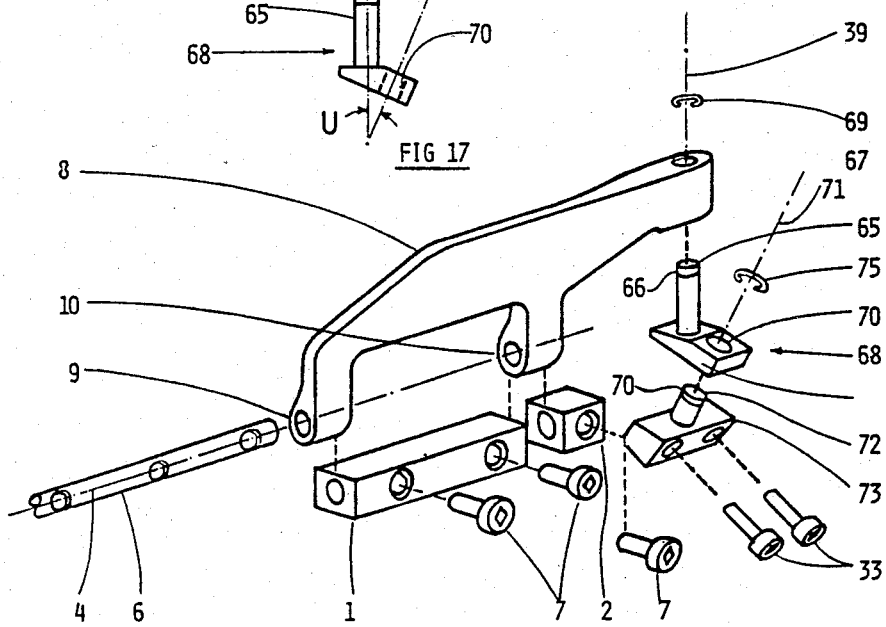
Figure 21A:
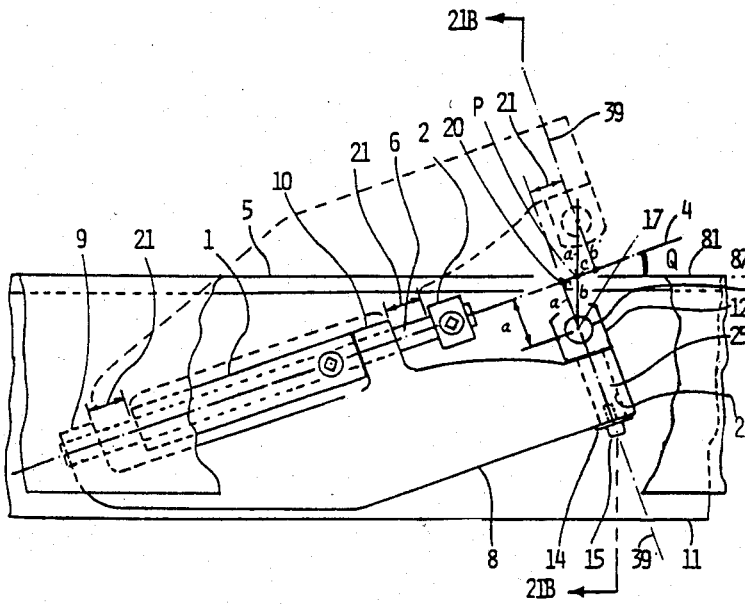
Figure 21B:
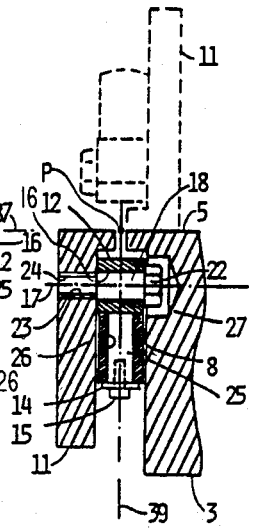
Figure 20:
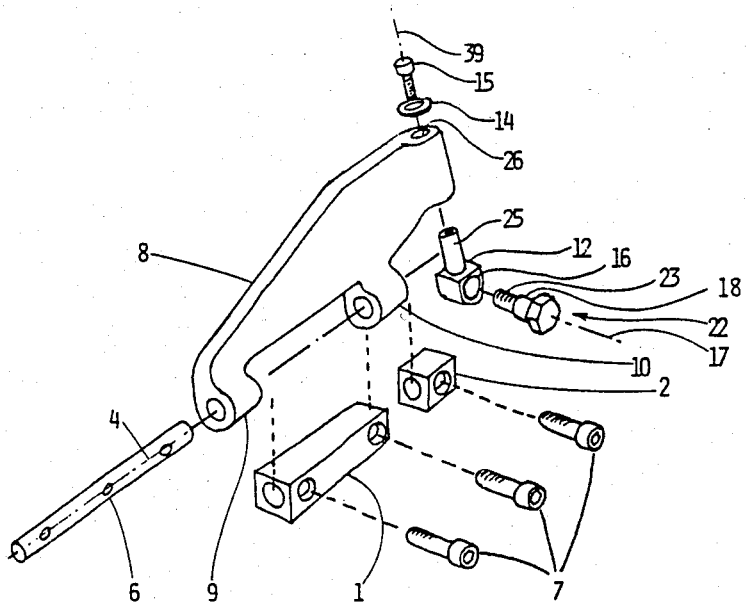
Figure 23:
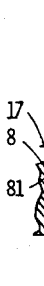
Figure 22:
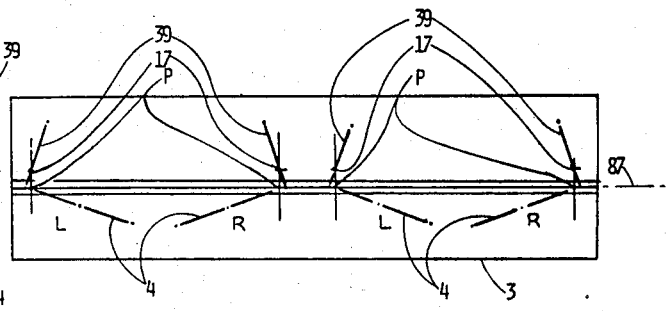
Figure 24A:
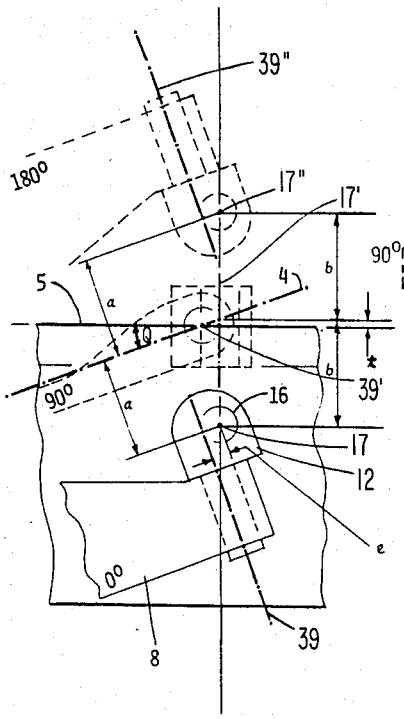
Figure 24B:
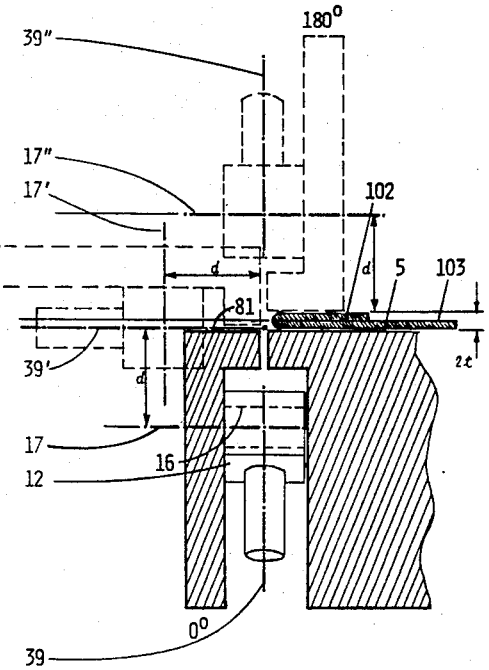

Preferred constructions in accordance with this invention and certain problems associated with conventional hinges will now be described with the aid of the accompanying drawings in which:

FIG. 1 is an elevational view of a conventional hinge applied to a bending machine, FIG. 2 is an end view of the conventional hinge applied to a bending machine in one position, FIG. 3 is an end view of the conventional hinge applied to a bending machine in another position, FIG. 4 is an elevational schematic representation of a hinge in accordance with this invention in a bending machine, FIG. 5 is an end view schematic representation of a hinge in accordance with this invention in one position, FIG. 6 is an end view schematic representation of a hinge in accordance with this invention in another position, FIG. 7 is an exploded perspective view of a hinge in accordance with this invention which will hereinafter be referred to as "the spherical external hinge", FIG. 8A is an elevational view of the spherical external hinge in a bending machine in one position, FIG. 8B is a cross-sectional view on line 8B—8B in FIG. 8A, FIGS. 9A, 10A, 11A and 12A are elevational view of the spherical external hinge in a bending machine in other positions, FIGS. 9B, 10B, 11B and 12B are cross-sectional views on lines axially corresponding to line 8B—8B in FIG. 8A but in respect of said other positions shown in FIGS. 9A, 10A, 11A and 12A, FIG. 13 is an exploded perspective view of a hinge in accordance with this invention which will hereinafter be referred to as "the spherical internal hinge", FIG. 14A is an elevational view of the spherical internal hinge in a bending machine in one position, FIG. 14B is a cross-sectional view on line 14B—14B in FIG. 14A, FIG. 15 is an exploded perspective view of a hinge in accordance with this invention which will hereinafter be referred to as "the cranked hinge", FIG. 16A is an elevational view of the cranked hinge in a bending machine in one position, FIG. 16B is a cross-sectional view on line 16B—16B in FIG. 16A, FIG. 17 is an elevational view of a part of the cranked hinge, FIG. 18 is an exploded perspective view of a hinge in accordance with this invention which will hereinafter be referred to as "the cylindrical hinge", FIG. 19A is an elevational view of the cylindrical hinge in a bending machine in one position, FIG. 19B is a cross-sectional view on line 19B—19B in FIG. 19A, FIG. 20 is an exploded perspective view of a hinge in accordance with this invention which will hereinafter be referred to as "the trunnion hinge", FIG. 21A is an elevational view of the trunnion hinge in a bending machine in one position, FIG. 21B is a cross-sectional view on line 21B—21B in FIG. 21A, FIG. 22 is a schematic representation of a bending machine using a number of the trunnion hinge, FIG. 23 is an end view of the machine depicted in FIG. 22, FIG. 24A is an elevational view of a hinge in accordance with this invention which will hereinafter be referred to as "the modified trunnion hinge" in a bending machine, and FIG. 24B is an end view of a bending machine showing positional relationships obtainable by use of the modified trunnion hinge.

The present invention is easily considered from the point of view of its application in bending machines of the type shown in Australian Patent Specification No. 506,793.

To illustrate one of the problems that the present invention seeks to deal with reference is made to FIGS. 1–3 in which is shown a bending machine having an electromagnet comprised of a pole 3 and bending beam 11 which have work engaging surfaces 81 and 5. In one position of the bending beam, surface 81 lies in a plane which is the plane of surface 5 as shown in FIG. 3. The pole 3 and beam 11 are connected by a hinge 80 of conventional form which comprises a leaf 83 and a support 84 for a pivot pin 86. The pivot pin 86 defines a hinge line 87 which lies in the plane of surface 5.

In consequence, the surfaces 81 and 5 can move from lying in the plane of surface 5, through 90° to one another to being parallel as in FIG. 2.

However, the hinge 80 inevitably projects above the hinge line 87 and bending in the region of the hinge 80 will be limited if not impossible.

The hinge 80 can be recessed below the hinge line 87 by raising the height of surfaces 81 and 5 as shown by dot line in FIG. 3 but so doing is not practical as the hinge line 87 no longer coincides with the intersection of the planes of the surfaces 81 and 5.

To deal with the problem of parts of hinges projecting above the hinge line 87 the present invention provides a number of particular hinges which are illustrated schematically in FIGS. 4–6.

In FIGS. 4–6 the hinge 80 is replaced by a hinge 82 which comprises two supports 1 and 2 which are secured to pole 3 by mounting bolts 7. The supports 1 and 2 each have a bore which defines a first axis 4 on which is mounted a pivot pin 6.

Mounted for pivoting on the pivot pin 6 is a hinge plate 8. The hinge plate 8 is connected to the beam 11 by a coupling 90. Various versions of the coupling 90 will be described hereinafter. The plate 8 has lugs 9 and 10 which are bored to be received on the pivot pin 6.

The first axis 4 lies at an angle Q to the hinge line 87. That angle Q is not critical but for practical reasons will usually be between 10° and 45° with about 20° being most preferred.

As can be seen from FIG. 6, the hinge 82 lies below the surface 5 and as shown in FIG. 5 does not interfere with the surfaces 81 and 5 coming to being parallel.

In some instances of the hinges described below (FIGS. 7–19) the hinge plate 8 is restricted against sliding movement along the first axis 4 and in other instances (FIGS. 20–26) such movement is permitted. Hinges in which such movement is restricted are preferred.

The coupling 90 serves to compensate for the angle Q and acts to cause the pole 11 to move in the desired path and to restrict against undesired motion.

In the description that follows like reference numerals denote like parts.

Reference is made to FIGS. 7–12 which relate to the spherical external hinge.

In this instance, the coupling 90 is referenced as 91 and comprises a body 32 which has a partial spheric surface 30 and which is secured to the beam 11 by screws 33 and a partial spheric surface 31 on the hinge plate 8.

The surfaces 30 and 31 are both centred on a point P which is a point on the hinge line 87 which is intersected by the first axis 4. The surfaces 30 and 31 are thus made able to relatively rotate about point P and a second axis 39.

The spheric surfaces 30 and 31 are maintained in contact for sliding in relative rotation by a bolt 34 which is tapped into the hinge plate 8 at 37 and which has a lock nut 38. The bolt 34 is located on the second axis 39 but is not essential for defining that second axis 39 which exists because of the particular geometry of the coupling 91 and not merely because of the existence of the bolt 34.

Indeed, if other suitable means can be found to maintain the surfaces 30 and 31 in contact, the bolt 34 can be dispensed with. In this last respect a spring clip 89 shown by dash line in FIG. 8B might be used in lieu of bolt 34 to retain body 32 and hinge plate 8 in sliding contact at surfaces 30 and 31.

The bolt 34 is allowed to move in the body 32 by means of a slot 36 in the body 32 and has a head 40 which is located in a recess in body 32.

Movement of the coupling 91 in consequence of movement of the beam 11 is depicted in detail and can be considered to be a movement from a starting position shown in FIGS. 9A and B, successively through the positions shown in FIGS. 10A and B, FIGS. 11A and B, FIG. 12A and B and culminating in the position shown in FIGS. 8A and B.

The motion of surface 31 relative to surface 30 is rotation about the point P, but this motion can be considered as two simultaneous rotations: firstly from the starting position shown in FIGS. 9A and B and surface 31 undergoes an anti-clockwise rotation about the second axis 39 relative to surface 30 when viewed in the direction indicated by the arrow Y in FIG. 9A until a maximum anti-clockwise rotated position is reached as shown in FIGS. 11A and B whereafter the surface 31 undergoes a clockwise rotation about the second axis 39 relative to surface 30 until, as is shown in FIGS. 8A and B, the surface 31 has the same relative rotation with respect to surface 30 about the second axis 39 as was shown in FIGS. 9A and B; and secondly the surface 31 undergoes an anti-clockwise rotation about axis 88 relative to surface 30 when viewed in the direction indicated by the arrow Z in FIG. 11A which successively increases through FIGS. 9A and B, FIGS. 10A and B, FIGS. 11A and B, FIGS. 12A and B and reaches a maximum as shown in FIGS. 8A and B.

In FIGS. 9A and B–12A and B some parts are not shown for reasons of clarity of depiction.

As will be realised from reference to FIGS. 9A and B–12A and B and FIGS. 8A and B, no part of the spherical external hinge projects above a plane including surfaces 81 and 5 in FIG. 9B or at any time lies within the angle included by surfaces 81 and 5.

In a modification of the bending machine using the spherical external hinge part of the beam 11 lying between the dotted parallel lines in FIG. 12B may be not present to provide a gap within which a seam being bent may be accommodated.

Reference is made to FIGS. 13–14 which relate to the spherical internal hinge.

In this instance, the coupling 90 is referenced 92.

The coupling 92 is functionally substantially the same as the coupling 91 but in this instance the surface 31 is carried by a body 131 and the surface 30 is located within a body 132.

The body 131 has a male thread at 41 and is received in a female threaded hole 42 in the hinge plate 8.

The body 132 has the surface 30 located in a cavity 43. The sides of the cavity lying parallel with the beam 11 act as guides 44 for the bolt body 131 and are spaced apart equal to the part 45 of the body 131 plus clearance.

Surfaces 30 and 31 are both centred on point P which is also intersected by first axis 4 and second axis 39.

The bolt 34 and locknut 38 serve a similar function in the spherical internal hinge as in the spherical internal hinge and the head 40 is located in a groove 135. However, the bolt 34 is threaded into the body 131.

The spherical internal hinge operates similarly as the spherical external hinge but it is to be noted that in addition the guides 44 guide the motion of the body 131.

Reference is made to FIGS. 15–17 which relate to the cranked hinge.

In this instance the coupling 90 is referenced 93.

The coupling 93 comprises a body 73 which is secured to the pole 11 by screws 33. The body 73 has a spindle 72 which is located on a third axis 71 and has a circlip groove 70 for a circlip 75.

Mounted for rotation on the spindle 72 is a body 68 which has a hole 70 to accommodate the spindle 72 and a spindle 65 which has a circlip groove 66 for a circlip 69. The spindle 65 is received in a hole 67 in the hinge plate 8.

The first axis 4, second axis 39 and third axis 71 intersect at point P.

The coupling 93, although operating differently to couplings 91 and 92, at least in that body 68 acts as a crank, achieves the desired movement of the beam 11 with respect to the pole 5 without any part of the cranked hinge at any time being within the angle included by surfaces 81 and 5.

It is to be noted that the beam 11 is recessed at 76 to accommodate the body 68 when in the position shown in FIG. 16B.

As shown in FIGS. 15–17, the first axis 4 and the second axis 39 are perpendicular and the axis 71 is perpendicular to the hinge line 87. None of this particular geometry is essential in that a change in one angle can be compensated for by a change in another angle. In the construction shown in FIGS. 15–17 the angle U between the second axis 39 and third axis 71 is given by the mathematical expression:

$$U = 2 \arcsin \sqrt{\left(\operatorname{Sin} \frac{V}{2}\right)^2 + \left(\operatorname{Sin} \frac{Q}{2}\right)^2}$$

Reference is made to FIGS. 18–19 which relate to the cylindrical hinge.

In this instance, the coupling 90 is referenced 94.

The coupling 94 although physically somewhat similar to coupling 91 can be considered to be more like the coupling 93 in its manner of operation in that there is a rotation about a third axis 171 rather than a rotation about point P as in the case of the coupling 91.

The coupling 94 comprises a body 173 which is secured to the beam 11 by screws 33. The body 173 has cylindrical surfaces 58 and 60. The surface 58 has guides 44 upstanding therefrom parallel to the beam 11.

The coupling 94 also includes a body 168 which has a cylindrical surface 54 and a planar surface 56.

In this instance, the hinge plate 8 has a planar surface 52.

The coupling 94 is held together by a bolt 51 which passes through hole 57 in the hinge plate 8 and a nut 59 which has a cylindrical surface 53. A slot 61 permits movement of the bolt 51 in the body 173.

The cylindrical surfaces 54, 58, 60 and 53 are all centred on the third axis 171.

The first axis 4 and second axis 39 are perpendicular and the third axis 171 is perpendicular to the hinge line 87 although this geometry is not essential. Further, the third axis 171 non-essentially lies in the plane of the surface 5. Still further, the first axis 4, second axis 39 and third axis 171 intersect at point P.

The coupling 94, although operating differently to couplings 91–93 achieves the desired movement of the beam 11 without any part of the cylindrical hinge at any time being within the angle included by surfaces 81 and 5. It is particularly to be noted that the guides 44 prevent sliding of the body 168 in the direction of the third axis 171 and restrict sliding of the body 168 on the body 173 to be rotated relative thereto through an angle 2Q about the third axis 171 while the hinge plate 8 at surface 52 relatively rotates with respect to body 168 about the second axis 39.

In the case of the hinges described above, it will be usual to use at least two thereof in any bending machine although one together with a conventional hinge might be used.

The above described hinges can be made in mirror image form if desired but it is not necessary of any two hinges in a bending machine that one be the mirror image of the other.

Reference is made to FIGS. 20–22 which relate to the trunnion hinge.

In this instance the coupling 90 is referenced 95.

In the case of the trunnion hinge the hinge plate 8 is free to slide a distance 21 along the first axis 4. The distance 21 is determined by the geometry of the trunnion hinge as will be explained hereinafter.

The coupling 95 comprises a body 12 having a hole 16 in which is received a bolt 22 having a tapped end 23 and a bearing surface 18. The tapped end 23 is received in a tapped bore 24 in the beam 11 and the bearing surface 18 permits rotation of the body 12 about a third axis 17. The body 12 also has a spindle 25 which is internally tapped to receive a screw 15 which passes through a washer 14 to retain the spindle 25 within a hole 26 in the hinge plate 8. The hole 26 defines a second axis 39.

The pole 3 is recessed at 27 to accommodate the bolt 22 when in the position shown in FIG. 21B.

In this instance the first axis 4 and the second axis 39 intersect at right angles but, with respect to FIG. 21A, at a point 20 below a plane including surface 5. The third axis 17 is displaced a distance "a" represented by 22 from point 20 and point P is here defined as being the intercept of the first axis 4 and a vertical plane including the third axis 17. The distance between points 20 and P can be called "c" and that between point P and axis 17 in FIG. 21A can be called "b". The angle between "a" and "b" is desirably Q.

The coupling 95, although operating differently to couplings 91–94 sufficiently approximately achieves the desired movement of the beam 11 for practical purposes without any part of the trunnion hinge at any time being within the angle included by surfaces 81 and 5. It is particularly to be noted that the body 12 rotates about the third axis 17 while the hinge plate relatively rotates about the second axis 39 with respect to the body 12.

The distance 21 will be equal to 2c and will be equal to 2a tan Q.

As previously indicated, motion is approximate and there will be a slight error equal to b−a and will be equal to $$a\left(\frac{1}{\cos Q} - 1\right).$$

Small but defined perturbations of the rotation of beam 11 about the hinge line 87 may be incorporated into the design of the trunnion hinge; for instance, by altering the distance a, the angle Q, the angle between the first axis 4 and the second axis 39 and between the second axis 39 and the third axis 17.

Because of the sliding motion 21 of the hinge plate 8, it is necessary to use at least three trunnion hinges in a bending machine of which one should be the mirror image of the others and may be considered to be right R and left L hand versions. However, the use of four trunnion hinges is preferred and this is illustrated in FIGS. 22 and 23. Fewer trunnion hinges may be used if means is provided to restrict longitudinal movement of the beam 11 with respect to pole 3.

Reference is made to FIGS. 24A and 24B which show, in schematic form, a portion of the modified trunnion hinge which is the same as the trunnion hinge excepting that the third axis 17 is offset from the second axis 39 by a distance "e" which may be 2.5 mm. That offset results in the motion of the beam 11 in the first 90° of travel being more nearly exact and when the beam 11 and pole 3 are at 180° as shown in dash line in FIG. 24B a gap 2t exists which is suitable for closing a seam 102 in a work piece 103.

In FIGS. 24A and B, where the hinge is depicted in broken outline rotated to the 90° and 80° positions, the axes 17 and 39 are respectively referenced 17' and 39', and 17'' and 39''.

The distance t equals (e tan Q) and the distance b equals (a/cosQ). The distance "d" between axis 17 and bending beam surface 81 is equal to (b−t).

Modifications and adaptations may be made to the above described without departing from the spirit and scope of this invention which includes every novel feature and combination of features disclosed herein.

I claim:

1. A hinged article comprising
first body (3),
second body (11),
hinge means interconnecting the first (3) and second (11) bodies and defining a hinge line (87)
and wherein the hinge means includes
a hinge which comprises
a first member (8) pivotally mounted to the first body (3) about a first pivot axis (4) which is inclined (Q) to the hinge line (87), and
a coupling (91, 92, 94) for articulating the first member (8) to the second body (11);
said coupling defining a second axis (39) fixed relative to the first member (8) such that a projection of the second axis (39) intersects a projection of the first axis (4),
said coupling (91, 92, 94) being arranged to lie entirely on one side of at least one plane passing through the intersection of the projections of the first (4) and second (39) axes, and
said coupling (91, 92, 94) additionally defining a third axis (88, 171, 17) fixed relative to the second body (11) about which the second axis (39) can pivot and which third axis (88, 171, 17) intersects a projection of the second axis (39) at a constant angle for all hinged orientations of the first body (3) and the second body (11),
the third axis (88, 171, 17) being defined by bearing surfaces (16, 18, 30, 31, 54, 58, 60) which extend on each side of a plane normal to the third axis (88, 171, 17) passing through the intersection of the projection of the second axis (39) and the third axis (88, 171, 17),
whereby loads borne, in use, by said coupling (91, 92, 94) will be distributed on each side of said plane normal to the third axis (88, 171, 17).

2. A hinged article as claimed in claim 1, characterized in that the first member (8) is mounted for reciprocating sliding motion (21) along the first axis (4).

3. A hinged article (FIGS. 20–24) as claimed in claim 2, characterized in that said coupling (95) includes second mounting means interconnecting said coupling (95) to the second body (11) and in that said coupling (95) comprises a second member (12) pivotally attached to the first member (8) to pivot about the second axis (39) and pivotally attached to the second mounting means to pivot about the third axis (17) and in that the third axis (17) does not intersect projections of the first axis (14).

4. A hinged article as claimed in claim 3, characterized in that projections of the second axis (39) do not intersect the third axis (17).

5. A hinged article (FIGS. 7–14, 18, 19) as claimed in claim 1, characterized in that said coupling comprises mating concave (31, 54) and convex (30, 58) load bearing surfaces having a common centre of curvature centred on a point (P) being at an intersection of the projections of the first (4) and second (39) axes, the third (88) axis and, in use, the hinge line (87).

6. A hinged article (FIGS. 13, 14, 18, 19) as claimed in claim 5, characterized in that parallel spaced apart guide means (44) is positioned on opposite sides of the convex surfaces (30, 58) to guide the motion of the first member (8).

7. A hinged article (FIGS. 18, 19) as claimed in claim 1, characterized in that said coupling (94) comprises a second member (168) mounted to the first member (8) to rotate about the second axis (39) and adapted to rotate about the third axis (171).

8. A hinged article (FIGS. 18, 19) as claimed in claim 7, characterized in that said coupling (94) comprises a concave partial cylindrical surface (54) carried by the second member (168) and a mating convex partial cylindrical surface (58) adapted to be carried by the second body (11) and wherein the axes (171) about which the partial cylindrical surfaces (54, 58) are formed intersect at a point (P) being at an intersection of the projections of the first (4) and second (39) axes, the third (171) axis and, in use, the hinge line (87).

9. A hinged article as claimed in claim 1 and which is a bending machine.

10. A hinge comprising
means defining a first pivot axis (4),
mounting means for mounting the first pivot axis means to a first body (3),
a first member (8) pivotally mounted to the first body (3) about a first pivot axis (4) which is inclined (Q), in use, to a hinge line (87), and
a coupling (91, 92, 94) for articulating the first member (8) to a second body (11);
said coupling defining a second axis (39) fixed relative to the first member (8) such that a projection of the second axis (39) intersects a projection of the first axis (4),
said coupling (91, 92, 94) being arranged to lie entirely on one side of at least one plane passing through the intersection of the projections of the first (4) and second (39) axes, and
said coupling (91, 92, 94) additionally defining a third axis (88, 171, 17) fixed, in use, relative to the second body (11) about which the second axis (39) can pivot and which third axis (88, 171, 17) intersects a projection of the second axis (39) at a constant angle for all hinged orientations of the first body (3) and the second body (11),
the third axis (88, 171, 17) being defined by bearing surfaces (16, 18, 30, 31, 54, 58, 60) which extend on each side of a plane normal to the third axis (88, 171, 17) and passing through the intersection of the projection of the second axis (39) and the third axis (88, 171, 17),
whereby loads borne, in use, by said coupling (91, 92, 94) will be distributed on each side of said plane normal to the third axis (88, 171, 17).

11. A hinge as claimed in claim 10, characterized in that the first mounting means (1, 2, 6) is such as to mount the first member (8) for reciprocating sliding motion (21) along the first axis (4).

12. A hinge (FIGS. 20–24) as claimed in claim 11, characterized in that said coupling (95) includes second mounting means for interconnecting said coupling (95) to the second body (11) and in that said coupling (95) comprises a second member (12) pivotally attached to the first member (8) to pivot about the second axis (39) and pivotally attached to the second mounting means to pivot about the third axis (17) and in that the third axis (17) does not intersect projections of the first axis (4).

13. A hinge as claimed in claim 12, characterized in that projections of the second axis (39) do not intersect the third axis (17).

14. A hinge (FIGS. 7–14, 18, 19) as claimed in claim 10, characterized in that said coupling (91) comprises mating concave (31, 54) and convex (30, 58) load bearing surfaces having a common centre of curvature centred on a point (P) being at an intersection of the projections of the first (4), and second (39) axes, the third (88) axis and, in use, the hinge line (87).

15. A hinge (FIGS. 13, 14, 18, 19) as claimed in claim 14, characterized in that parallel spaced apart guide means (44) is positioned on opposite sides of the convex surface (30, 58) to guide the motion of the first member (8).

16. A hinge (FIGS. 18, 19) as claimed in claim 10, characterized in that said coupling (94) comprises a second member (168) mounted to the first member (8) to rotate about the second axis (39) and adapted to rotate about the third axis (171).

17. A hinge (FIGS. 18, 19) as claimed in claim 16, characterized in that said coupling 94 comprises a concave partial cylindrical surface (54) carried by the second member (168) and a mating convex partial cylindrical surface (58) adapted to be carried by the second body (11) and wherein the axes (171) about which the partial cylindrical surfaces (54, 58) are formed intersect at a point (P) being at an intersection of the projections of the first (4) and second (39) axes, the third (171) axis and, in use, the hinge line (87).

* * * * *